US006283400B1

(12) United States Patent
Stiller et al.

(10) Patent No.: US 6,283,400 B1
(45) Date of Patent: Sep. 4, 2001

(54) CHEESE-PRODUCING TEXTILE MACHINE

(75) Inventors: Joachim Stiller, Wegberg; Franz-Josef Flamm, Stolberg; Christian Sturm, Krefeld, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/348,193

(22) Filed: Jul. 6, 1999

(30) Foreign Application Priority Data

Jul. 6, 1998 (DE) ..... 198 30 101

(51) Int. Cl.[7] ..... B65H 49/00

(52) U.S. Cl. ..... 242/474; 242/474.1; 242/473.5; 242/473.6; 242/474.2

(58) Field of Search ..... 242/474, 474.1, 242/131, 473.5, 473.6, 474.2

(56) References Cited

U.S. PATENT DOCUMENTS

| | | | | |
|---|---|---|---|---|
| 3,854,275 | * | 12/1974 | Bethea et al. | 57/281 |
| 3,913,853 | * | 10/1975 | Raasch | 242/474.2 |
| 4,073,450 | * | 2/1978 | Carlsson et al. | 242/131 |
| 4,571,931 | * | 2/1986 | Kupper | 57/281 |
| 4,589,602 | * | 5/1986 | Reiners et al. | 242/474.2 |
| 4,630,435 | * | 12/1986 | Igel | 57/281 |
| 5,011,000 | * | 4/1991 | Kawasaki et al. | 198/465.1 |
| 5,113,995 | * | 5/1992 | Sakurai | 198/409 |
| 5,184,305 | * | 2/1993 | Gronenberg | 364/470.1 |
| 5,314,139 | | 5/1994 | Mori . | |

FOREIGN PATENT DOCUMENTS

| | | |
|---|---|---|
| 126 272 | 7/1977 | (DE) . |
| 21 18 443 C2 | 8/1982 | (DE) . |
| G 90 10 088.3 | 1/1992 | (DE) . |
| 195 10 308 C2 | 12/1997 | (DE) . |

* cited by examiner

*Primary Examiner*—Donald P. Walsh
*Assistant Examiner*—Minh-Chau Pham
(74) *Attorney, Agent, or Firm*—Kennedy, Covington, Lobdell & Hickman, LLP

(57) ABSTRACT

In a multi-station cheese-producing textile machine (1) for rewinding delivery bobbins (4) of large volume, each work position (2) has a manipulating and transport installation (3) by which delivery bobbins (4) are transferred from a loading position (I) to a winding position (III). Each manipulating and transporting arrangement (3) has a horizontally arranged transport unit (5), and an essentially vertically arranged transport unit (6). Transport elements (9', 9") for receiving delivery bobbins (4, 4', etc.) are arranged on the transport units (5, 6) in a definitively shiftable manner for transfer between one transport unit (5) and the other transport unit (6).

28 Claims, 5 Drawing Sheets

CHEESE-PRODUCING TEXTILE MACHINE

FIELD OF THE INVENTION

The present invention relates to a cheese-producing textile machine for rewinding delivery bobbins of large volume, and relates more particularly to such machines having a manipulating and transport installation for the delivery bobbins for transferring the delivery bobbins from a loading position to a winding position.

BACKGROUND OF THE INVENTION

Cheese producing textile machines of the above-identified type, preferably used for rewinding so-called dye bobbins, have been known for a long time and have been extensively described in various patent applications.

For example, German Published, Non-Examined Patent Application DE-OS 21 18 443 C2 discloses a textile machine, wherein each work station has a separate device for creeling of a large-volume delivery bobbin, for transferring this bobbin into an unwinding position, and for releasing the empty tube after rewinding to a disposal device. This so-called delivery device has three booms, which are arranged at the same distance, are seated rotatable around a horizontal axis and respectively have a bobbin holder at the ends. During the winding process, the booms are positioned in such a way that one bobbin holder with its large-volume delivery bobbin is in a winding position in the area of the work station of the textile machine, another bobbin holder is parked in a loading position where it can be equipped with a fresh delivery bobbin, and the bobbin holder of the third boom is in a drop position to transfer its empty tube to a following disposal device. During the manipulation process the delivery bobbins at times hang in an "overhead" position.

This delivery device, which has proven itself in practice, is quite elaborate in its mechanical structure. In addition, the manipulation of a large-volume delivery bobbin, which at times is moved through an "overhead" position, requires a very solid and expensive construction.

OBJECT AND SUMMARY OF THE INVENTION

In view of the above mentioned prior art, an object of the invention is to provide an improvement of the above described type of delivery device for cheese-producing textile machines.

Briefly summarized, the present invention is applicable to a cheese-producing textile machine of the basic type adapted for rewinding delivery bobbins of large volume by means of a plurality of rewinding work positions. In accordance with the present invention, the foregoing objective is attained by providing each work position with an arrangement for manipulating and transporting the delivery bobbins, including transferring the delivery bobbins between a loading position and a winding position, wherein each manipulating and transporting arrangement has a first transport unit essentially horizontally arranged, a second transport unit essentially vertically arranged, and transport elements adapted to be transferred between the first transport unit and the second transport unit and to be arranged on each transport unit shiftably in a defined manner for receiving a delivery bobbin.

Thus, the embodiment of a manipulating and transporting arrangement in accordance with the invention with two separate transport units, i.e. a transport unit which essentially extends horizontally, and an almost vertically extending transport unit, results in a practical, i.e. cost-effective and rugged construction.

The transport operation of the transport elements which take up the delivery bobbins here takes place in a common transport plane, which extends for example orthogonally in relation to the longitudinal axis of the textile machine. The transport units themselves are constructed to be relatively narrow, so that the work stations have a comparatively close spacing, which has very positive effects on the space requirements of the entire textile machine.

The transport elements are seated on the two transport units in a defined shiftable manner in such a way that they can be introduced into various positions and can be transferred from one transport unit to the other transport unit without problems.

Preferably, the transport elements have an arbor for securely fixing in place of a delivery bobbin to extend parallel with the inclination of the vertically-arranged second transport unit.

Not only are the delivery bobbins securely fixed in place during transport, the inclined arrangement of the arbors of the transport elements also results in an optimal orientation of the delivery bobbins during the winding process, as well as an ergonomically advantageous position for the operators when the transport elements must again be equipped with fresh large-volume delivery bobbins.

It is further preferred that the two transport units have separate respective devices for the defined shifting of the transport elements. In a preferred embodiment, the horizontally arranged transport unit has an endless traction means equipped with carriers, which can be actuated by means of a reversible drive. Transport elements can be connected to these carriers via coupling devices, which may for example be forklike, on their undersides. The transport elements, which can be easily released when necessary, can be connected to the horizontal transport unit by means of these fork-like coupling devices which extend from above over the carriers on the endless traction means.

In the preferred embodiment, several carriers, most preferably five, are arranged at equal spacings from one another on the endless traction means which, in the course of shifting the transport elements, can pass over reversing wheels arranged at the end of the traction means. The carriers of the endless traction means work together with the fork-like coupling devices at the transport elements and thereby assure a dependable and positionally correct shifting of the transport elements on the horizontally arranged transport unit.

In an alternative embodiment of the manipulating and transporting arrangement, an arrangement of only two carriers may be provided on the endless traction means such that the carriers need not run over the reversing wheels arranged at the transport ends of the traction means. However, the use of only two carriers, which do not pass over the reversing wheels, requires a somewhat longer transport unit. Moreover, such a device must operate at two different step sequences, which are alternatingly actuated.

It is further preferred that the transport elements can be placed in three defined positions on the horizontal transport unit, i.e. in a winding position, a transfer position and an intermediate position. The individual positions can in this case be taken up in a predetermined sequence of steps, which assures a smooth winding operation at the respective winding head.

The drive device for the vertically-arranged transport unit preferably has a threaded spindle which is acted upon by a reversible drive. A transport carriage can be easily displaced upwardly or downwardly via this threaded spindle, depending on the direction of spindle rotation, to be adjusted between a transfer position located in the area of the first transport unit and a loading position spaced therefrom.

Preferably, the transport carriage of the elevator-like transport unit has a fixation device for the transport elements. Thus, on the one hand, the transport elements, and therefore the delivery bobbins, are securely fixed in place during their transport, and on the other hand a problem-free transfer of the transport elements between the individual transport units is possible.

The reversible drives of the transport units are preferably designed as stepper motors. Not only are such stepper motors very cost-effective and dependable, but when employed in connection with an electronic control device, for example a winding head computer, they also make the exact positioning of the transport element possible.

Further features, advantages and details of the present invention will be understood from the exemplary embodiments described below with reference to the accompanying drawings.

DETAILED DESCRIPTION OF THE PREFERRED EMBODIMENTS

Figure 1:
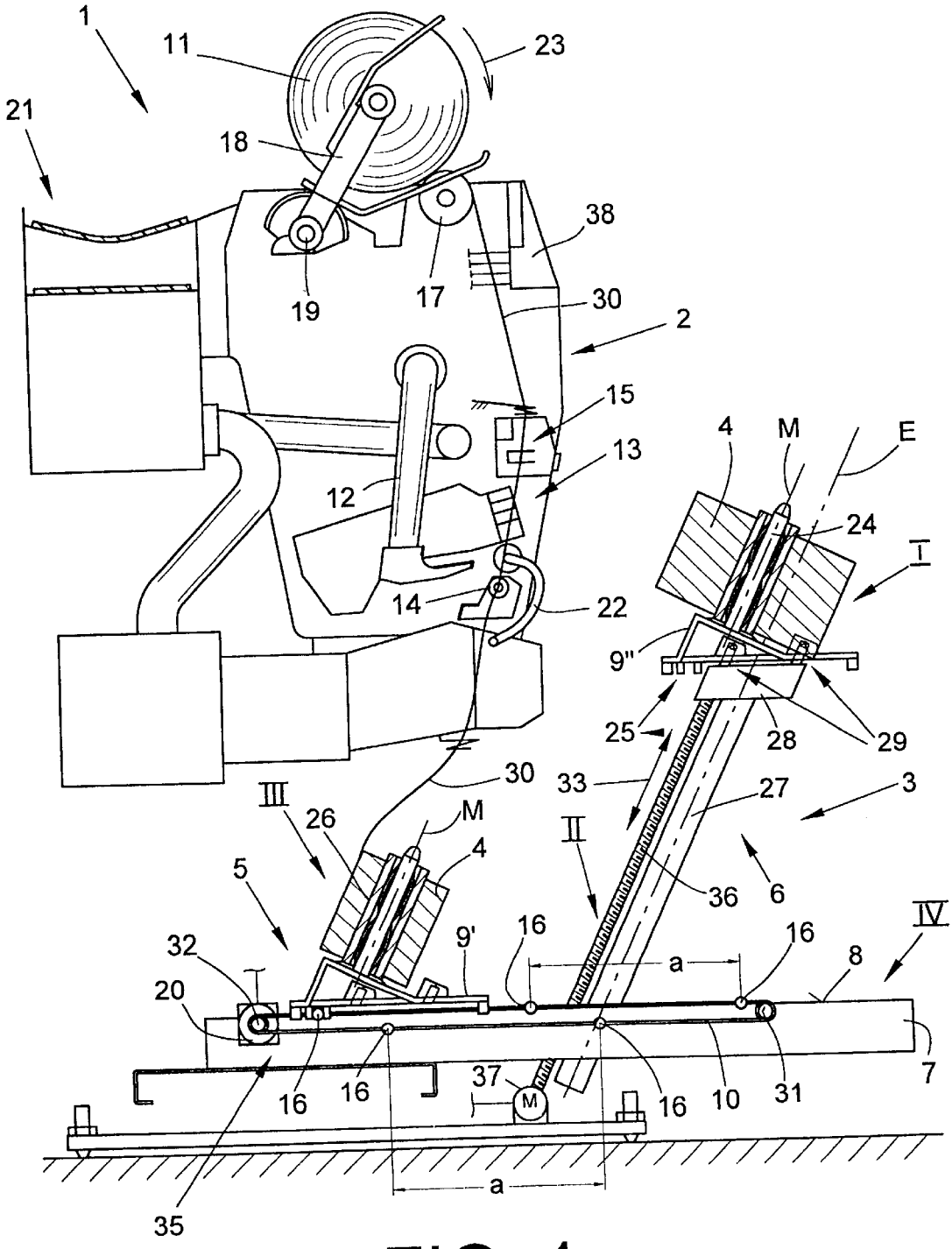
FIG. 1 is a side elevational view of a work station of a cheese-producing textile machine for rewinding large-volume delivery bobbins depicting a first embodiment of a manipulating and transporting arrangement in accordance with the present invention.

Referring now to the accompanying drawings and initially to FIG. 1, a work station 2 of a cheese-producing textile machine 1 with a manipulating and transporting arrangement 3 in accordance with the present invention is represented in a lateral view. Here, the individual work stations have various devices, known per se, which are required for the correct operation of such work stations.

In FIG. 1, by way of example, a yarn running from a delivery bobbin 4 to a cheese 11 is represented at 30, a suction nozzle at 12, a gripper tube at 22, a splicing device at 13, a yarn tensioning unit at 14 and a yarn cleaner with a yarn cutting device at 15. A cheese drive drum 17 drives the cheese 11 during the winding process via a frictional connection therebetween, in the direction of the arrow 23. The cheese 11 is held during the winding process in a creel 18 which is seated pivotably around a shaft 19. A swivel plate is preferably arranged underneath the creel 18, also for limited pivotability around the pivot shaft 19, over which swivel plate the finished cheese 11 can be transferred to a cheese transport device 21 arranged behind the winding units 2.

The work stations 2 of the textile machine 1 are supplied by means of a service unit (not represented), typically in the form of a so-called cheese changer. This cheese changer is operative to transfer a cheese 11 which has reached a predetermined diameter to the cheese transport device 21, and thereafter to transfer an empty tube from an empty tube magazine of the changer into the creel 18.

The manipulating and transporting arrangement 3 for the delivery bobbins 4 essentially has two separate transport units 5, 6, respectively. In this case, the transport unit 5 is preferably horizontally arranged, while the transport unit 6, designed as an elevator-like arrangement, is arranged approximately vertically.

As indicated in FIG. 1, the transport unit 5 has a longitudinal guide body 7, on whose surface 8 transport elements 9 are displaceably seated. The shifting of these transport elements 9 takes place by means of an endless traction means 10 having several carriers 16, the endless traction means 10 being driven in a reversible manner by means of an electric motor 20. In the embodiment in accordance with FIG. 1, the endless traction means 10 preferably has five carriers 16, which are arranged in relation to each other at respectively equal distances a.

Each of the transport elements 9 has an arbor 24 for fixing a delivery bobbin 4 in place, as well as a coupling device 25 on the underside of the transport element. The transport elements 9 can be fastened on the carriers 16 of the endless traction means 10 of the transport unit 5 by means of the coupling devices 25.

The transport unit 6 has a guide body 27, which is arranged at an angle in respect to the transport unit 5 and on which a transport carriage 28 is guided to be displaceable in height. In this case, the transport carriage 28 can preferably be shifted between the elevated loading position I and the lowered transfer position II adjacent the transport unit 5 by means of a threaded spindle 36, to which a reversible electric motor, for example a stepper motor 37, is connected. In an alternative embodiment, shifting of the transport carriage 28 along the guide body 27 can also take place by other drive means, for example a drivable toothed belt or a pneumatic thrust piston gear.

A respective one of the transport elements 9 can be fixed in place on the transport carriage 28 by means of a fixation device 29. In the process, the transport carriage 28 can be shifted in a defined manner between the loading position I and the transfer position II located in the area of the transport unit 5.

Figure 2A:
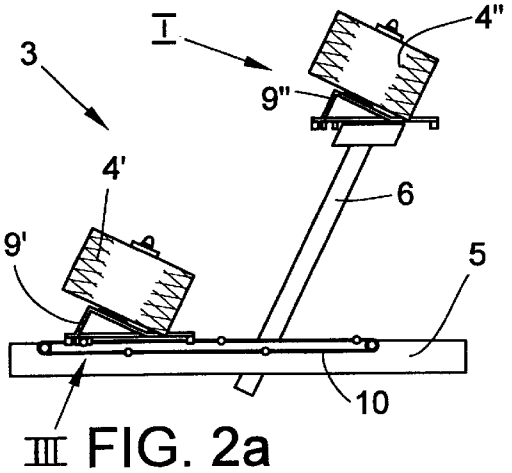
FIGS. 2*a* to 2*f* depict the preferred sequence of individual work steps of the manipulating and transporting arrangement in accordance with FIG. 1.

The functioning of the manipulating and transporting arrangement 3 represented in FIG. 1 is depicted in, and may be understood with reference to, FIGS. 2*a* to 2*f*. The situation represented in FIG. 2*a* represents an initial starting position wherein a delivery bobbin 4' rests on a transport element 9' of the transport unit 5 in the winding position III which, as can be seen from FIG. 1, is located underneath the work station 2. At this moment, the delivery bobbin 4' is being unwound, as shown in FIG. 1 but not represented in FIG. 2*a*. In addition, a further delivery bobbin 4" is kept ready in a loading position I of a transport element 9" of the transport unit 6.

Figure 2B:
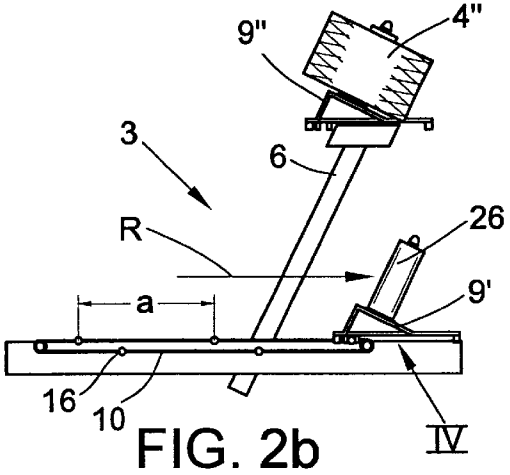

As soon as the delivery bobbin 4' is empty, the transport element 9', which now has an empty tube 26, is shifted into the intermediate position IV, as indicated in FIG. 2*b*, by movement of the endless traction means 10 in the direction of the arrow R by a distance equivalent to two spacings a between the carriers 16.

Figure 2C:
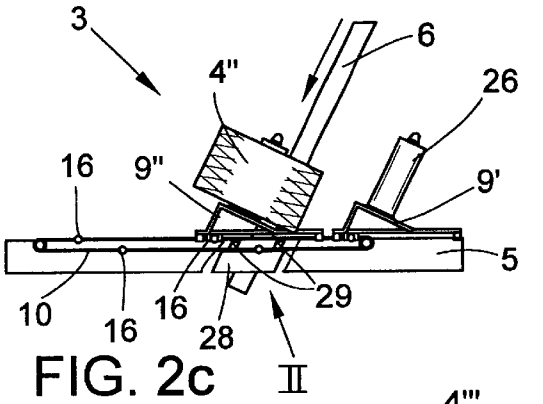

Subsequently or simultaneously, the transport carriage 28 of the transport unit 6 is lowered via the spindle 36 into the transfer position II, as shown in FIG. 2*c*. In the process, the transport element 9" is placed with its coupling device 25 over an appropriately positioned carrier 16 of the endless traction means 10 of the transport unit 5. Thereafter, the endless traction means 10 is acted upon in the reverse direction to move by one carrier spacing a in the direction of the arrow V as shown in FIG. 2*d*.

Figure 2D:
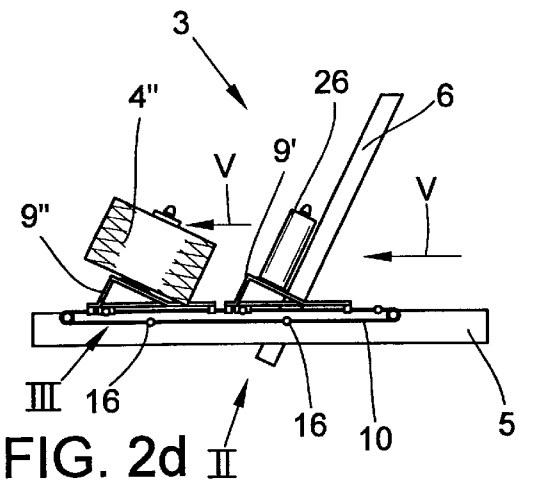

As indicated in FIG. 2*d*, in the course of this movement, the delivery bobbin 4" arranged on the transport element 9" is conveyed into the winding position III, and the empty tube 26 arranged on the transport element 9' is conveyed into the transfer position II.

Figure 2E:
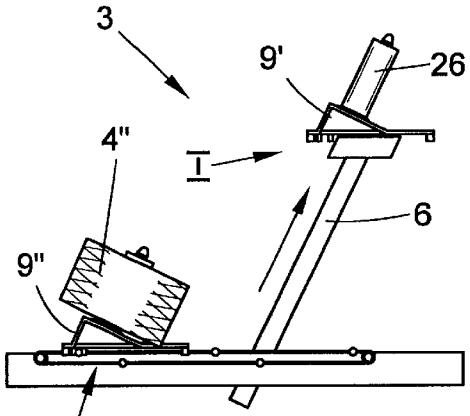
Figure 2F:
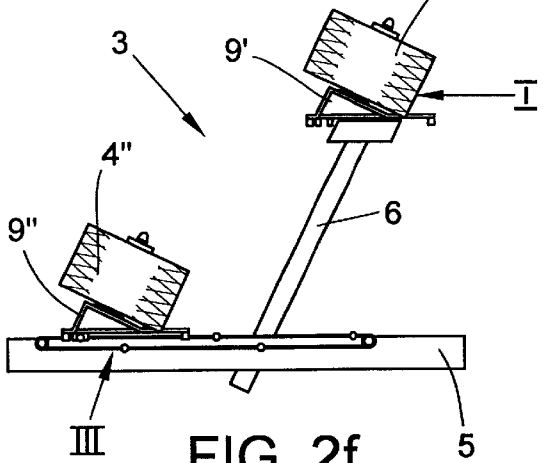

Thereafter, as indicated in FIG. 2*e*, the transport element 9' with the empty tube 26 is lifted into the loading position I by raising of the transport carriage 28 of the transport unit 6 via reverse actuation of the spindle. Once the transport carriage 28 has reached the loading position 1, or when the transport carriage 28 has left the transfer position II, rewinding of the new delivery bobbin 4" can be started. The empty tube 26 can then be exchanged for a fresh delivery bobbin 4'" in the loading position I, as indicated in FIG. 2*f*.

With this step, the exchange cycle is ended and the initial situation, represented in FIG. 2*a*, has been reached again. Thereafter the above described exchange cycle can be repeated as often as necessary.

Figure 3:
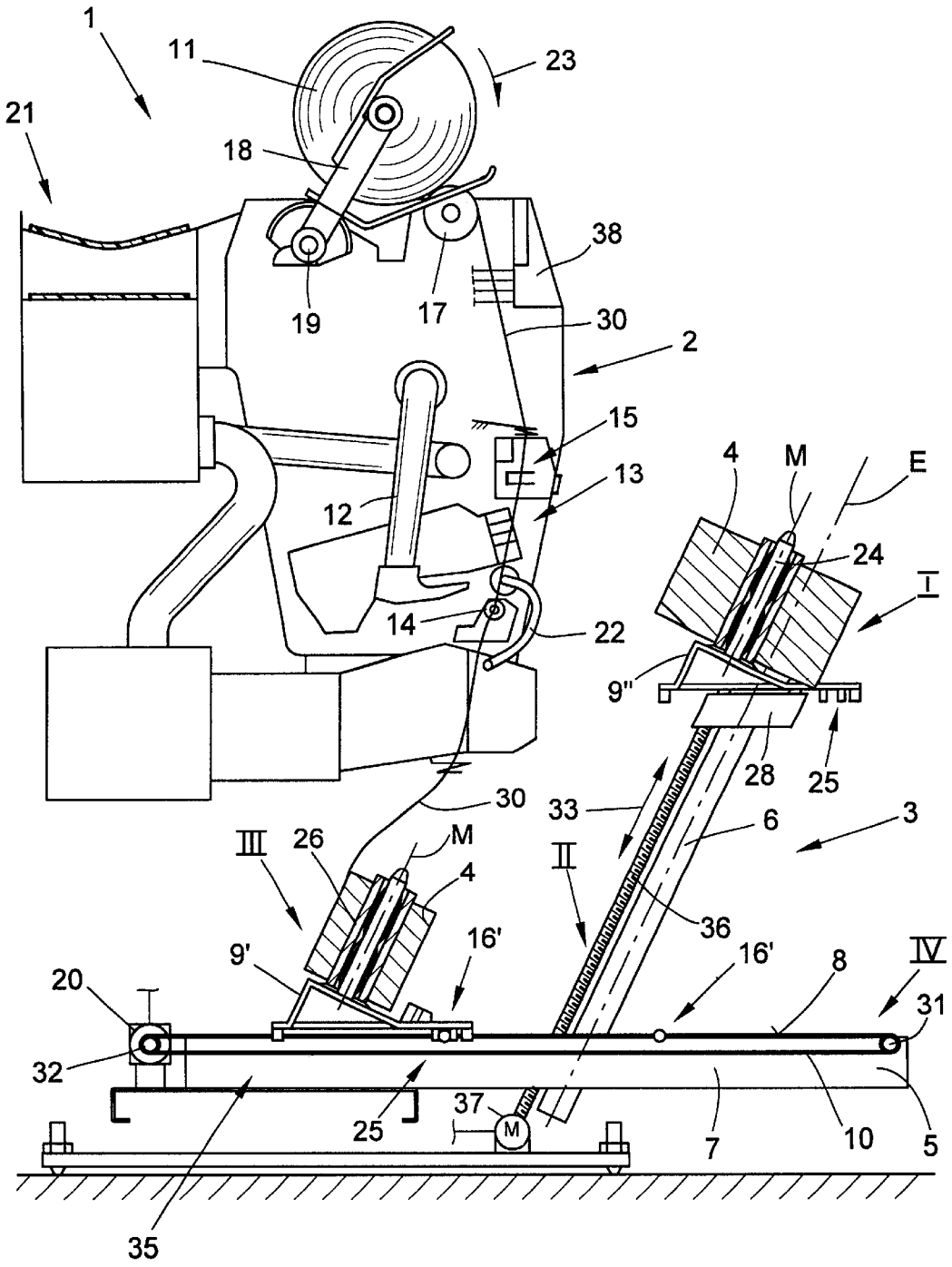
FIG. 3 is a side elevational view, similar to FIG. 1, of a work station of a cheese-producing textile machine for rewinding large-volume delivery bobbins depicting a second embodiment of a manipulating and transporting arrangement in accordance with the present invention.

FIG. 3 depicts an alternative embodiment of a manipulating and transporting arrangement 3 which is slightly modified from the embodiment in FIG. 1. In this embodiment, the guide body 7 of the transport unit 5 and the endless traction means 10, in particular, are designed to be somewhat longer than with the embodiment in FIG. 1. In addition, the endless traction means 10 only has two carriers, identified by 16', which may be displaceably guided in corresponding guides (not represented) of the guide body 7 of the transport unit 5 or may simply slide on the surface 8 of the guide body 7. In this case, the carriers 16' can be definitively shifted between the reversing wheels 31 and 32. An additional difference in this embodiment is that the position of the coupling device 25 on the transport elements 9 is changed as shown in FIG. 3.

Figure 4A:
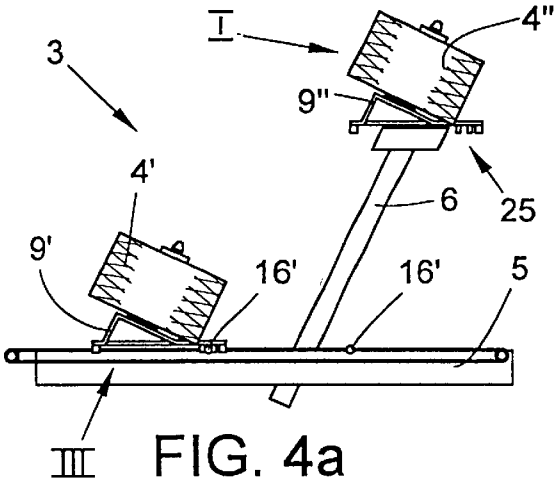
FIGS. 4*a* to 4*k* depict the preferred sequence of individual work steps of the manipulating and transporting arrangement in accordance with FIG. 3.
Figure 4B:
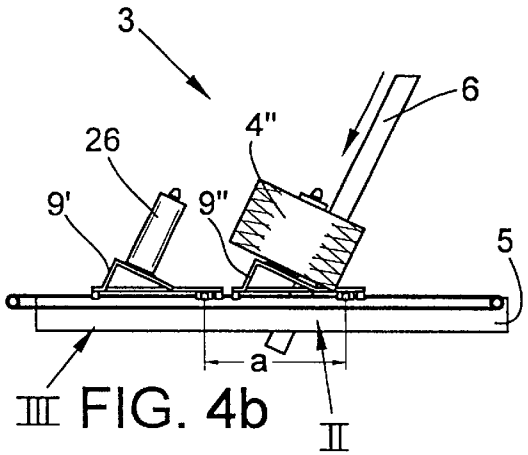

The exchange cycle of the embodiment of the manipulating and transporting arrangement 3 in accordance with FIG. 3 is as follows, as depicted in FIGS. 4*a* to 4*k*. In the initial position represented in FIG. 4*a*, a delivery bobbin 4' is located in a winding position III on a transport element 9' of the transport unit 5 and, at the moment, is being unwound. In addition, a delivery bobbin 4" is kept ready in the loading position I on a transport element 9" of the transport unit 6. After the delivery bobbin 4' has been unwound, the delivery bobbin 4" is lowered into the transfer position II in the area of the horizontally extending transport unit 5, as indicated in FIG. 4*b*.

Figure 4C:
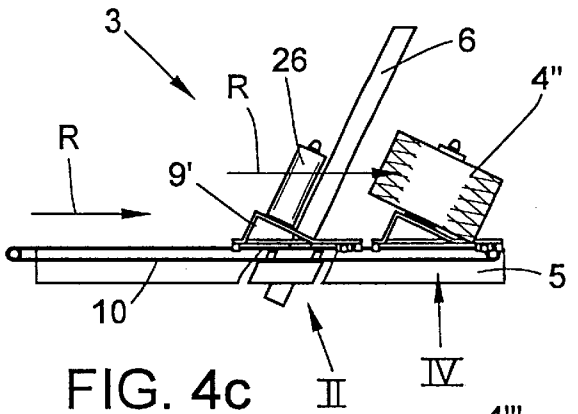

Thereafter, the endless traction means 10 is moved by one carrier spacing a in the direction R. In the process, the transport element 9' is shifted into the transfer position II, and the transport element 9" is shifted into the intermediate position IV, as represented in FIG. 4*c*.

Figure 4D:
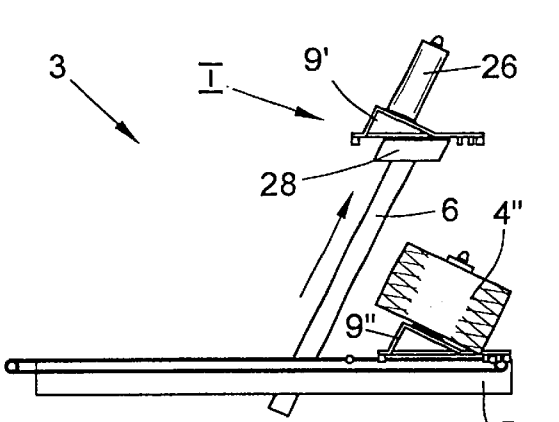
Figure 4E:
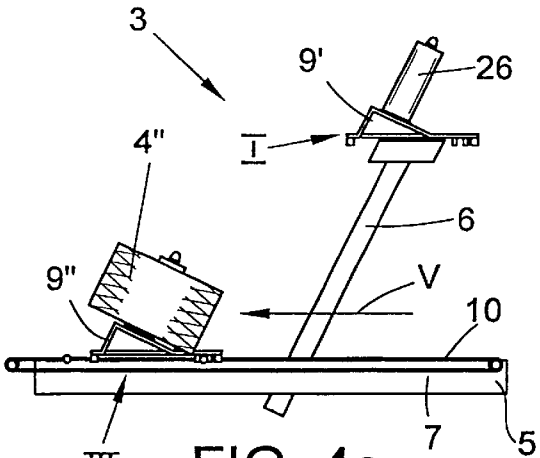
Figure 4F:
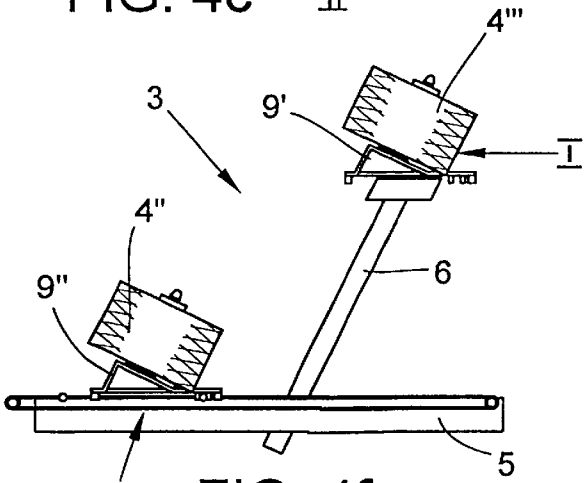

Subsequently the transport element 9' with the empty tube 26 is moved into the loading position I of the transport unit 6 by elevation of the transport carriage 28 via the threaded spindle 36, as shown in FIG. 4*d*. Then, the endless traction means 10 is moved forwardly (direction V) by two carrier spacings a and in the process thereby shifts the transport element 9" with the delivery bobbin 4" into the winding position III, as indicated in FIG. 4*e*, whereupon unwinding of the new bobbin 4" can begin. While the delivery bobbin 4" is unwound, the transport element 9' in the loading position I can be equipped with a fresh delivery bobbin 4'" (FIG. 4*f*).

Figure 4G:
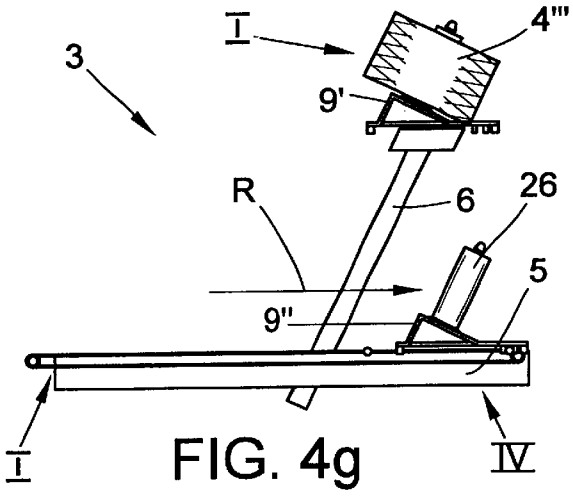
Figure 4H:
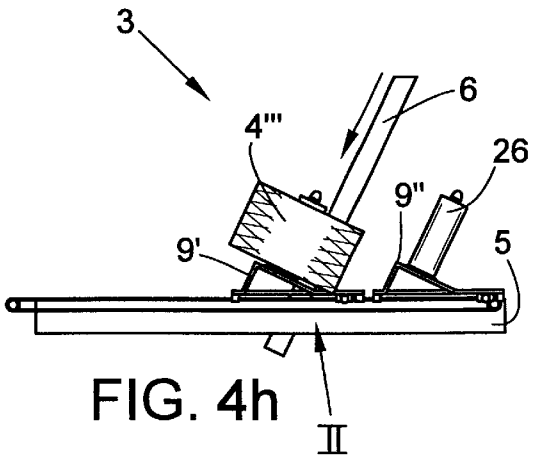
Figure 4I:
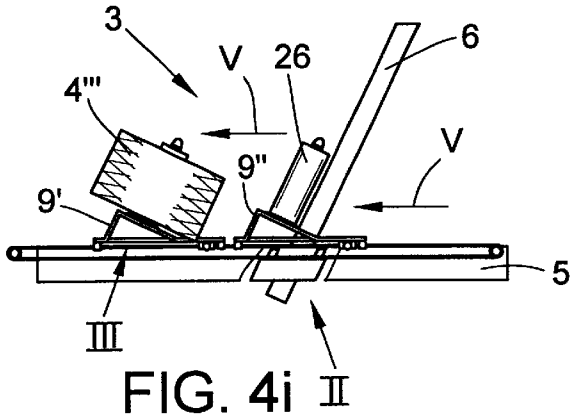
Figure 4J:
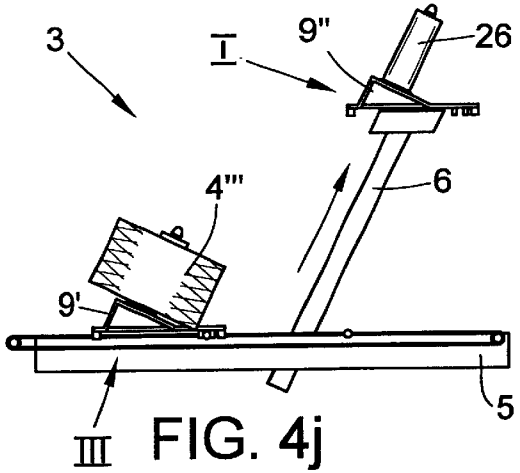

Following the rewinding of the delivery bobbin 4", the transport element 9", which then carries an empty tube 26, must first be shifted out of the loading position I by two carrier spacings a into the intermediate position IV, as shown in FIG. 4*g*. Thereafter, the transport element 9' with the delivery bobbin 4'" can be lowered into the transfer position II (FIG. 4*h*) to transfer the transport element 9' onto the endless traction means 10. As soon as the transport element 9' has been transferred to the endless traction means 10, the two transport elements 9' and 9" are again shifted by a carrier spacing a in the direction V, as indicated in FIG. 4*i*. Thereupon, the transport element 9' with the new delivery bobbin 4'" is in the winding position III, while the transport element 9" with the empty tube 26 is in the transfer position II and can be lifted into the loading position I by means of the transport device 6 (FIG. 4*j*).

Figure 4K:
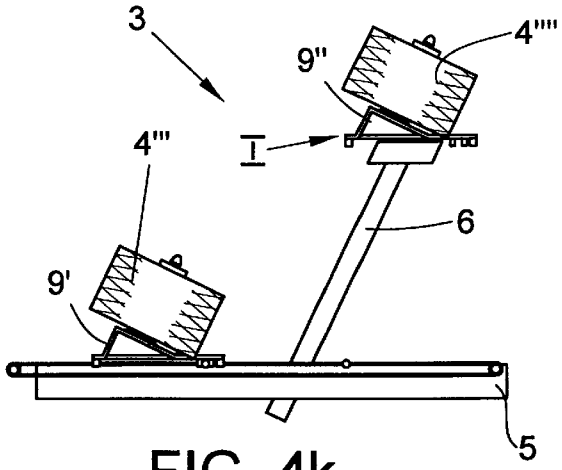

While the delivery bobbin 4'" is rewound, the empty tube 26 can be exchanged in the loading position I with a delivery bobbin 4"", as represented in FIG. 4*k*. The situation in FIG. 4*k* corresponds to the initial situation in FIG. 4*a*, so that thereafter the above described exchange cycle can be repeated as often as required.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cheese-producing textile machine for rewinding delivery bobbins having a plurality of rewinding work positions, each work position comprising:

a) an arrangement permanently installed at said work position for manipulating and transporting the delivery bobbins, including (i) an elevational transport unit extending between a first position whereat a delivery bobbin is received, and a second position vertically differing from said first position, and (ii) a lateral transport unit extending between a third position, whereat a full delivery bobbin is unwound at said rewinding work position, and a fourth position horizontally differing from said third position, said lateral transport unit arranged relative to said elevational transport unit such that said second position of said elevational transport unit is located adjacent said lateral transport unit at a position thereon intermediate said third and fourth positions.

2. The cheese-producing textile machine in accordance with claim 1, wherein each said transport unit has a longitudinal guide body.

3. The cheese-producing textile machine in accordance with claim 1, further comprising, (b) an empty delivery bobbin tube carried on said lateral transport unit and that moves from said third position to said fourth position; and (c) a full delivery bobbin tube releasably carried on said elevational transport unit and that moves (i) from said first position to said second position, and (ii) then from said second position on said elevational transport unit to said intermediate position on said lateral transport unit when said empty delivery bobbin tube is in said fourth position on said lateral transport unit.

4. The cheese-producing textile machine in accordance with claim 1, further comprising, (b) a full delivery bobbin tube releasably carried on said elevational transport unit and that moves (i) from said first position to said second position, (ii) then from said second position on said elevational transport unit to said intermediate position on said lateral transport unit, and (iii) then from said intermediate position on said lateral transport unit to said fourth position on said lateral transport unit; and (c) an empty delivery bobbin tube releasably carried on said lateral transport unit and that moves (i) from said third position to said intermediate position on said lateral transport unit when said full delivery bobbin tube moves from said intermediate position to said fourth position on said lateral transport unit, and (ii) then from said intermediate position on said lateral transport unit to said second position on said elevational transport unit when said full delivery bobbin tube is in said fourth position on said lateral transport unit.

5. The cheese-producing textile machine in accordance with claim 2, wherein said lateral transport unit includes an endless traction means having carriers for moving a delivery bobbin tube and a reversible drive for acting upon the traction means.

6. The cheese-producing textile machine in accordance with claim 5, further comprising a transport element releasably supported on said transport units and moveable on said transport units and between said transport units for carrying said full delivery bobbin tube, and wherein said transport element has a coupling device for connection with a said carrier of said endless traction means.

7. The cheese-producing textile machine in accordance with claim 5, wherein said carriers are equally spaced from one another along said traction means.

8. The cheese-producing textile machine in accordance with claim 5, further comprising a shifting device including reversing wheels for controlling movement of said endless traction means and wherein said endless traction means includes two carriers which can be shifted between said reversing wheels.

9. The cheese-producing textile machine in accordance with claim 2, wherein said elevational transport unit includes a threaded spindle and a reversible drive for acting upon the threaded spindle.

10. The cheese-producing textile machine in accordance with claim 5 or 9, characterized in that the reversible drives of the lateral and elevational transport units comprise stepper motors.

11. The cheese-producing textile machine in accordance with claim 10, characterized by an electronic control device for actuation of the stepper motors.

12. The cheese-producing textile machine in accordance with claim 3, wherein a transport element includes an arbor for receiving a delivery bobbin tube.

13. The cheese-producing textile machine in accordance with claim 12, wherein said elevational transport unit is oriented along its length between said first and second Positions at an inclination to vertical, and wherein said arbor of said transport element is inclined to the vertical at substantially the same inclination.

14. The cheese-producing textile machine in accordance with claim 3, wherein a transport element is supported on said elevational transport unit by engagement with a carriage.

15. The cheese-producing textile machine in accordance with claim 14, wherein said transport carriage includes a fixating device engaged with said transport element for temporary fixing in place said transport element on said carriage.

16. The cheese-producing textile machine in accordance with claim 3 or 4, further comprising a transport element releasably supported on said transport units and moveable thereon and therebetween for carrying said full delivery bobbin tube.

17. The cheese-producing textile machine in accordance with claim 3 or 4, wherein said elevational transport unit comprises a threaded spindle.

18. The cheese-producing textile machine in accordance with claim 3 or 4, wherein said lateral transport unit comprises a conveyor.

19. The cheese-producing textile machine in accordance with claim 18, wherein a transport element is supported on said lateral transport unit by engagement with a carrier attached to said conveyor.

20. The cheese-producing textile machine in accordance with claim 3 or 4, wherein said empty delivery bobbin tube moves from said intermediate position on said lateral transport unit to said second position on said elevational transport unit, and then to said first position whereat said empty delivery bobbin tube is picked-up.

21. The cheese-producing textile machine in accordance with claim 4, wherein said empty delivery bobbin tube and said full delivery bobbin tube move in synchronicity when said empty delivery bobbin tube moves from said third position to said intermediate position and said full delivery bobbin tube moves from said intermediate position to said fourth position.

22. The cheese-producing textile machine in accordance with claim 4, wherein said lateral transport unit comprises only two carriers.

23. The cheese-producing textile machine in accordance with claim 4, wherein a first spacing along said lateral transport unit between said third position and said intermediate position is substantially identical to a second spacing along said lateral transport unit between said intermediate position and said fourth position.

24. The cheese-producing textile machine in accordance with claim 4, wherein said full delivery bobbin tube moves from said first position on said elevational transport unit to said second position on said elevational transport unit, and then to said intermediate position on said lateral transport unit when said empty delivery bobbin tube is in said third position.

25. A cheese-producing textile machine for rewinding delivery bobbins of large volume, comprising a plurality of rewinding work positions each having an arrangement for manipulating and transporting the delivery bobbins, including transferring the delivery bobbins between a loading position and a winding position, each manipulating and transporting arrangement having a lateral transport unit essentially horizontally arranged, an elevational transport unit essentially vertically arranged, and transport elements adapted to be transferred between the lateral transport unit and the elevational transport unit and to be seated on each transport unit for shifting among plural positions for receiving a delivery bobbin, characterized in that each transport element has an arbor for receiving a delivery bobbin, and further characterized in that the elevational transport unit is adapted for vertically shifting of the transport elements and is arranged at an inclination to vertical, and the arbor of each transport unit has a central axis oriented parallel with the inclination of the elevational transport unit.

26. A cheese-producing textile machine for rewinding delivery bobbins of large volume, comprising a plurality of rewinding work positions each having an arrangement for manipulating and transporting the delivery bobbins, including transferring the delivery bobbins between a loading position and a winding position, each manipulating and transporting arrangement having a lateral transport unit essentially horizontally arranged, an elevational transport unit essentially vertically arranged, and transport elements carried on and adapted to be transferred between the lateral transport unit and the elevational transport unit and to be seated on each transport unit for shifting among plural positions for receiving a delivery bobbin, characterized in that each transport unit has a longitudinal guide body and the lateral and elevational transport units each has a device for shifting each of the transport elements along the guide body of the respective transport unit, and further characterized in that the shifting device of the elevational transport unit comprises a threaded spindle and a reversible drive for acting upon the threaded spindle.

27. A cheese-producing textile machine for rewinding delivery bobbins of large volume, comprising a plurality of rewinding work positions each having an arrangement for manipulating and transporting the delivery bobbins, including transferring the delivery bobbins between a loading position and a winding position, each manipulating and transporting arrangement having a lateral transport unit essentially horizontally arranged, an elevational transport unit essentially vertically arranged, and transport elements carried on and adapted to be transferred between the lateral transport unit and the elevational transport unit and to be seated on each transport unit for shifting among plural positions for receiving a delivery bobbin, characterized in that each transport unit has a longitudinal guide body and the lateral and elevational transport units each has a device for shifting each of the transport elements along the guide body of the respective transport unit, and further characterized in that the shifting device of the lateral transport unit comprises an endless traction means having carriers for the transport elements and a reversible drive for acting upon the traction means, each of the transport elements having a coupling device for connection with a said carrier of the endless traction means.

28. A cheese-producing textile machine for rewinding delivery bobbins of large volume, comprising a plurality of rewinding work positions each having an arrangement for manipulating and transporting the delivery bobbins, including transferring the delivery bobbins between a loading position and a winding position, each manipulating and transporting arrangement having a lateral transport unit essentially horizontally arranged, an elevational transport unit essentially vertically arranged, and transport elements carried on and adapted to be transferred between the lateral transport unit and the elevational transport unit and to be seated on each transport unit for shifting among plural positions for receiving a delivery bobbin, characterized in that each transport unit has a longitudinal guide body and the lateral and elevational transport units each has a device for shifting each of the transport elements along the guide body of the respective transport unit, and further characterized in that the shifting device of the lateral transport unit comprises an endless traction means having carriers for the transport elements and a reversible drive for acting upon the traction means, the endless traction means of the shifting device of the lateral transport unit having a plurality of the carriers equally spaced from one another along the traction means.

* * * * *